US005079923A

United States Patent [19]

Grenier

[11] Patent Number: 5,079,923

[45] Date of Patent: Jan. 14, 1992

[54] PROCESS AND APPARATUS FOR DISTILLATION OF AIR TO PRODUCE ARGON

[75] Inventor: Maurice Grenier, Paris, France

[73] Assignee: L'Air Liquide, Societe Anonyme Pour L'Etude et L'Exploitation des Procedes Georges Claude, Paris, France

[21] Appl. No.: 612,843

[22] Filed: Nov. 14, 1990

[30] Foreign Application Priority Data

Nov. 28, 1989 [FR] France ..... 89 15626

[51] Int. Cl.[5] ..... F25J 3/04

[52] U.S. Cl. ..... 62/22; 62/24

[58] Field of Search ..... 62/13, 24, 22

[56] References Cited

U.S. PATENT DOCUMENTS

| | | | |
|---|---|---|---|
| 3,447,331 | 6/1969 | Smith | 62/22 |
| 3,596,471 | 8/1971 | Streich | 62/22 |
| 4,783,208 | 11/1988 | Rathbone | 62/22 |
| 4,790,866 | 12/1988 | Rathbone | 62/22 |
| 4,871,382 | 10/1989 | Thorogood et al. | 62/24 |
| 4,916,908 | 4/1990 | Lavin et al. | 62/22 |

FOREIGN PATENT DOCUMENTS 2550325 2/1985 France .

*Primary Examiner*—Ronald C. Capossela
*Attorney, Agent, or Firm*—Young & Thompson

[57] ABSTRACT

The invention is concerned with a process of the type in which the air to be treated, from which water and $CO_2$ have been removed and which has been cooled at about its dew point, is injected at the base of the mean pressure column of the double column. A first fraction of rich liquid, withdrawn from the bottom of the mean pressure column is expanded and sent into a head condenser of a column for the production of impure argon connected to the low pressure column of the double column. A second fraction of rich liquid, withdrawn from the lower portion of the mean pressure column, is expanded and sent as reflux into the low pressure column. According to the invention, a second fraction of rich liquid is withdrawn from an intermediate point of the mean pressure column and a residual gas from the apparatus is formed from at least a portion of the rich liquid withdrawn from the bottom of the mean pressure column. The apparatus which is used to carry out this process enables to withdraw the second fraction of rich liquid from an intermediate point of the mean pressure column and comprises auxiliary devices to constitute a residual gas of the apparatus from at least a portion of the rich liquid which is withdrawn from the bottom of the mean pressure column.

18 Claims, 4 Drawing Sheets

PROCESS AND APPARATUS FOR DISTILLATION OF AIR TO PRODUCE ARGON

BACKGROUND OF INVENTION (a) Field of the Invention

The present invention relates to the technology of air distillation to produce argon by means of an apparatus for air distillation with double column. It concerns first a process of the type in which air to be treated, from which water and $CO_2$ have been removed and cooled at about its dew point, is injected at the base of the mean pressure column of the double column; a first fraction of rich liquid withdrawn at the bottom of the mean pressure column, is expanded and sent into a head condenser of a column for the production of impure argon connected to the low pressure column of the double column; and a second fraction of rich liquid, withdrawn from the lower portion of the mean pressure column is expanded and injected as reflux into the low pressure column.

(b) Description of Prior Art

To ensure certain productions, for example of argon in liquid form, as well as oxygen and nitrogen, also in liquid form, apparatuses for the treatment of air should be provided with a turbine in which a substantial portion of the flow of input air, for example 15 to 17 % of this flow, or an equivalent flow of mean pressure nitrogen, is expanded.

However, this leads to a deterioration of the conditions of distillation in the low pressure column, which results for example in a decrease of the yield of extraction of argon. A direct withdrawing of mean pressure nitrogen has similar consequences.

SUMMARY OF INVENTION

The invention aims at enabling to preserve a high yield of extraction of argon in spite of this unfavourable factor.

For this purpose, it is an object of the invention to provided a process of the type mentioned above, characterized in that:

(a) the second fraction of rich liquid is withdrawn from an intermediate point of the mean pressure column; and (b) a residual gas of the apparatus is obtained from at least a portion of the rich liquid which is withdrawn at the bottom of the mean pressure column.

It is also an object of the invention to provide an apparatus intended to carry out such process. This apparatus, of the type comprising a double distillation column includes a mean pressure column and a low pressure column, and a column for the production of impure argon connected to the low pressure column and including a head condenser, means to transfer into the head condenser a first fraction of rich liquid withdrawn at the bottom of the mean pressure column, and means to send by reflux, in the low pressure column, after expansion, a second fraction of rich liquid withdrawn from the lower portion of the mean pressure column, is characterized in that:

(a) the second fraction of rich liquid is withdrawn from an intermediate point of the mean pressure column; and (b) the apparatus comprises auxiliary means to provide a residual gas derived from the apparatus, from at least a portion of the rich liquid withdrawn at the bottom of the mean pressure column.

BRIEF DESCRIPTION OF DRAWINGS

Some embodiments of the invention will now be described with reference to the annexed drawings, in which.

DESCRIPTION OF PREFERRED EMBODIMENTS

Figure 1:
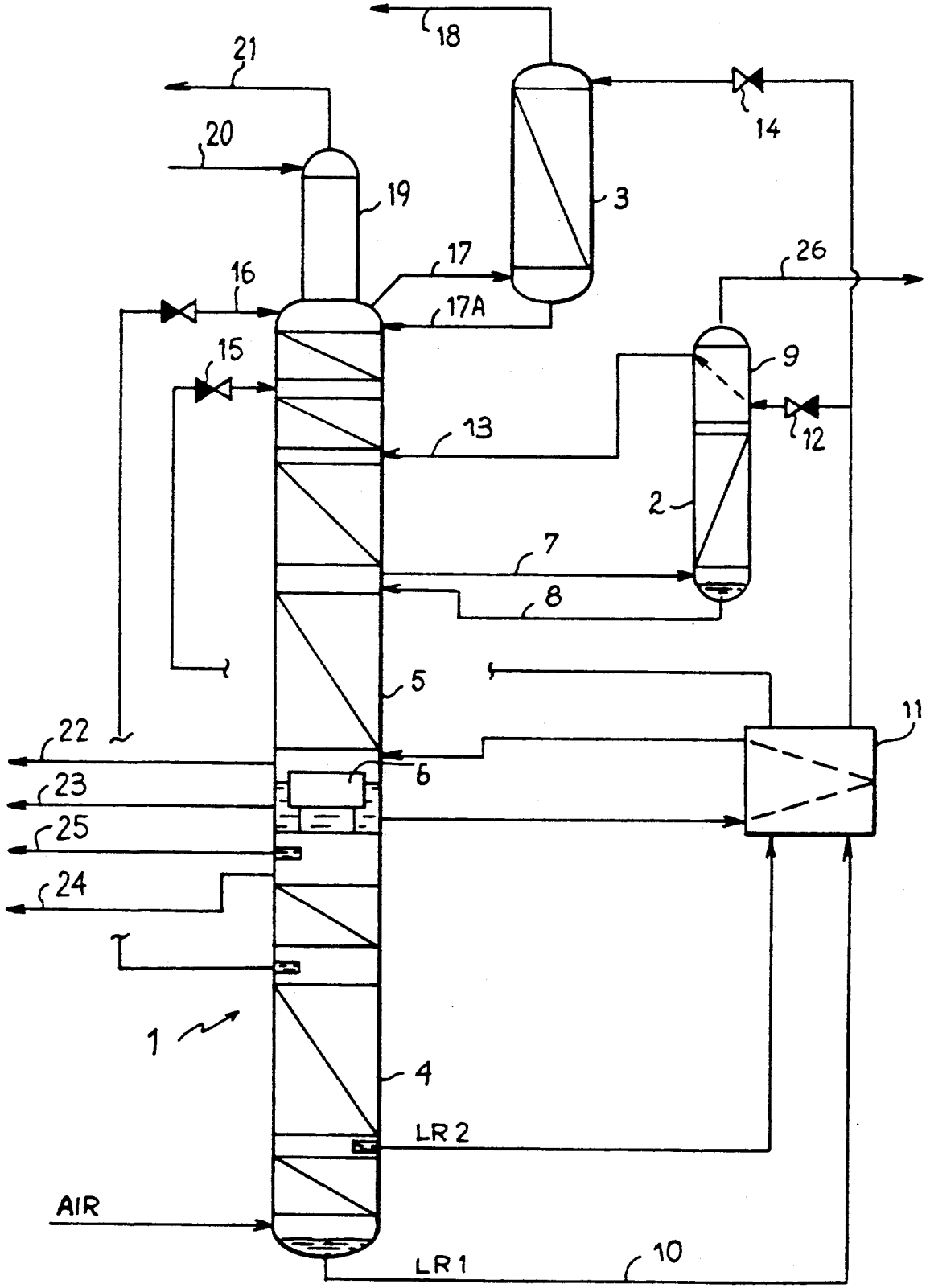
FIG. 1 is a schematic representation of an apparatus for the distillation of air according to the invention.

The apparatus represented in FIG. 1 essentially comprises a double distillation column 1, a column for the production of impure argon 2, and a mixing column section 3. In what follows, the pressures indicated are approximate absolute pressures.

The double column 1 comprises a mean pressure column 4 operating at about $6 \times 10^5$ Pa, which is surmounted by a low pressure column 5 operating slightly above $1 \times 10^5$ Pa. By means of a vaporizer-condenser 6, the vapor at the top of column 4 (nitrogen) is put into heat exchange with the liquid at the bottom of column 5 (substantially pure oxygen). A so-called argon tapping qas duct connects an intermediate point of the column 5 to the lower portion of column 2, from the bottom of which, a liquid return duct 8 reaches column 5, substantially at the same level. Column 2 includes a head condenser 9.

The air to be separated, which is compressed and free from water and $CO_2$, for example by adsorption, is injected at the base of column 4. A first "rich liquid'-'(oxygen enriched air) LR1, consisting of the liquid collected at the bottom of column 4, is removed via duct 10, sub-cooled in a sub-cooler 11, and divided in two flows or fractions:

- a first flow is expanded in an expansion valve 12 and entirely vaporized in condenser 9. The resulting gas is sent into column 5 via duct 13;
- the remaining portion is expanded in an expansion valve 14 and sent to the top of the column section 3.

The sub-cooler 11 is cooled by natural circulation of oxygen, withdrawn in liquid form from the bottom of column 5 and sent back to the latter after an at least partial vaporization.

A second rich liquid LR2, so-called superior rich liquid, is withdrawn from column 4 a few plates above the bottom, and more specifically close to the level where argon is at a maximum concentration. This liquid, after sub-cooling at 11, is expanded in an expansion valve 15 and sent as reflux to an intermediate point of column 5, above the outlet of duct 13. "Inferior poor liquid", rich in nitrogen, is withdrawn from an intermediate point of column 4 above liquid LR2 and, after expansion, is sent as reflux at the top of column 5, via duct 16.

Impure nitrogen containing a small quantity of oxygen is produced at the top of column 5, and is sent to the base of section 3 via duct 17; a liquid duct 17A runs from the bottom of the same section and ends at the top of column 5.

Thus, column section 3, although structurally similar to a distillation column provided with plates or lining, operates as a mixing column: the liquid which is received at the top contains less nitrogen, and is consequently less cold, than the one which is produced at the bottom, which corresponds to the operation of a heat pump and is obtained by the energy recovered by remixing the liquid LR1 and impure nitrogen under conditions close to reversability Duct 17A thus provides an additional reflux liquid containing little oxygen, at the top of column 5, and the vapor produced at the top of section 3 is removed from the apparatus via duct 18 as residual gas.

The low pressure column 5 is additionally surmounted with a "minaret" 19 which is used for producing pure nitrogen under $1 \times 10^5$ Pa. The base of this "minaret" is connected to the top of column 5 and is therefore fed by means of a portion of the impure nitrogen produced by the latter. Its reflux consists of liquid nitrogen supplied via duct 20. Low pressure nitrogen is produced at the top of "minaret" 19 and is removed via duct 21.

The apparatus, on the other hand, may produce gaseous oxygen, liquid oxygen, mean pressure gaseous nitrogen and mean pressure liquid nitrogen, via respective ducts 22 to 25. A portion of the gaseous nitrogen is liquefied by means of an auxiliary lique fraction cycle (not illustrated), and a portion of the liquid nitrogen thus produced feeds duct 20.

As a variant, a portion of the second flow of liquid LR1 (liquid LR1 not vaporized in condenser 9) could be directly sent as reflux after expansion, into column 5.

Impure argon is produced in gas form and is removed from the top of column 2 via duct 26.

Figure 2:
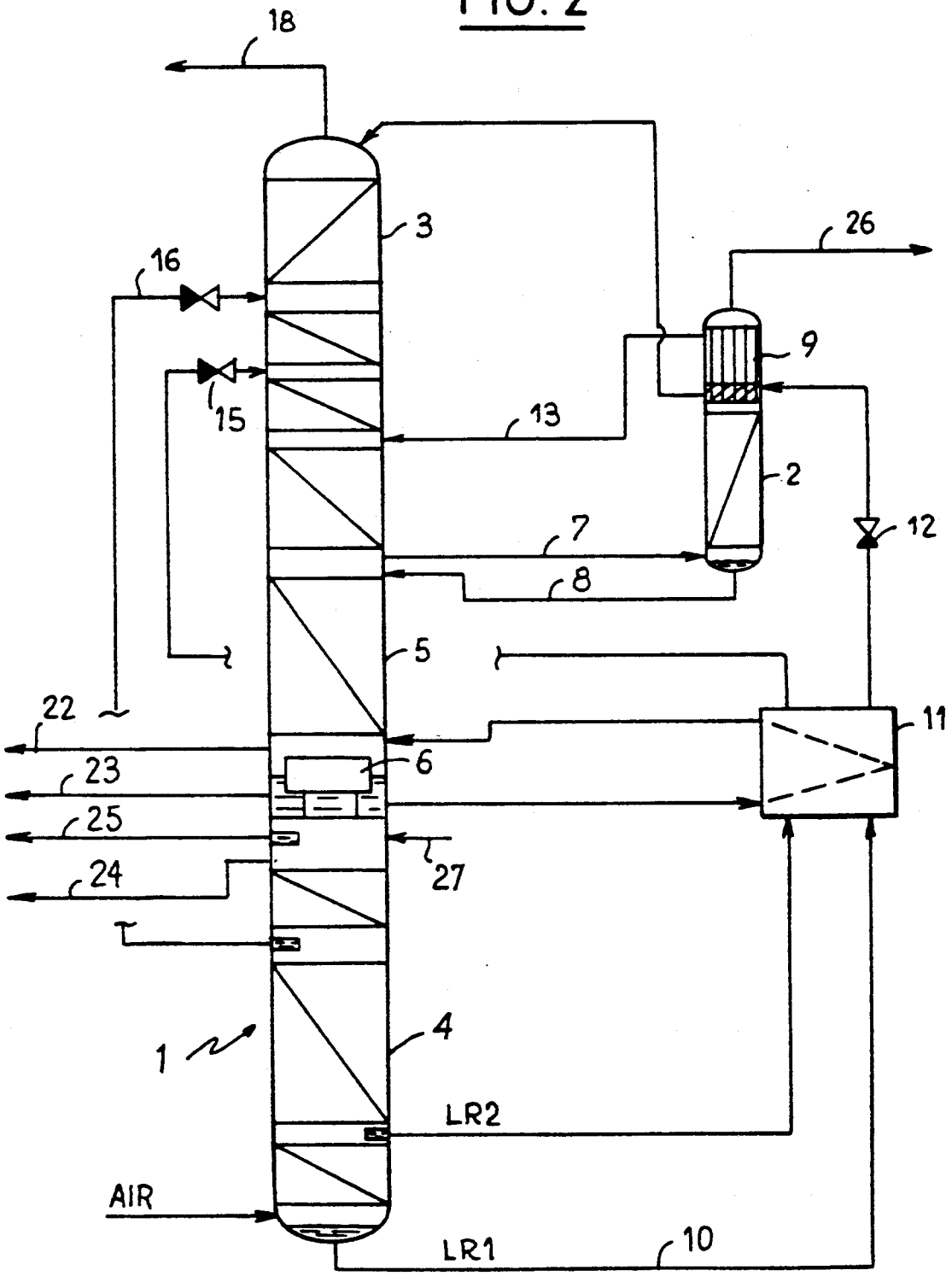
FIGS. 2 to 4 are similar views of three variants.

The essential elements described above with respect to FIG. 1 are also found in FIG. 2. The differences are the following:

On the one hand, the apparatus does not produce low pressure nitrogen, so that the minaret 19 is omitted. To simplify the construction, the mixing section 3 is then directly disposed above column 5, within the same coupling ring, and ducts 17, 17A and 21 are omitted. Moreover, duct 20 is omitted and the single duct 16 for feeding poor liquid into column 5 opens immediately below the base of section 3. On the other hand, a duct 27 for introducing liquid nitrogen at the top of column 4 has been represented in FIG. 2.

On the other hand, all the rich liquid LR1 is sent, after expansion in valve 12, into condenser 9. In the latter, only a portion of the liquid is vaporized, the resulting gas being sent as previously mentioned into column 5 via duct 13. The nonvaporized liquid, enriched in oxygen, is sent, as previously, to the top of section 3. As indicated previously, a portion of the non-vaporized liquid could be directly sent as reflux into column 5.

Figure 3:
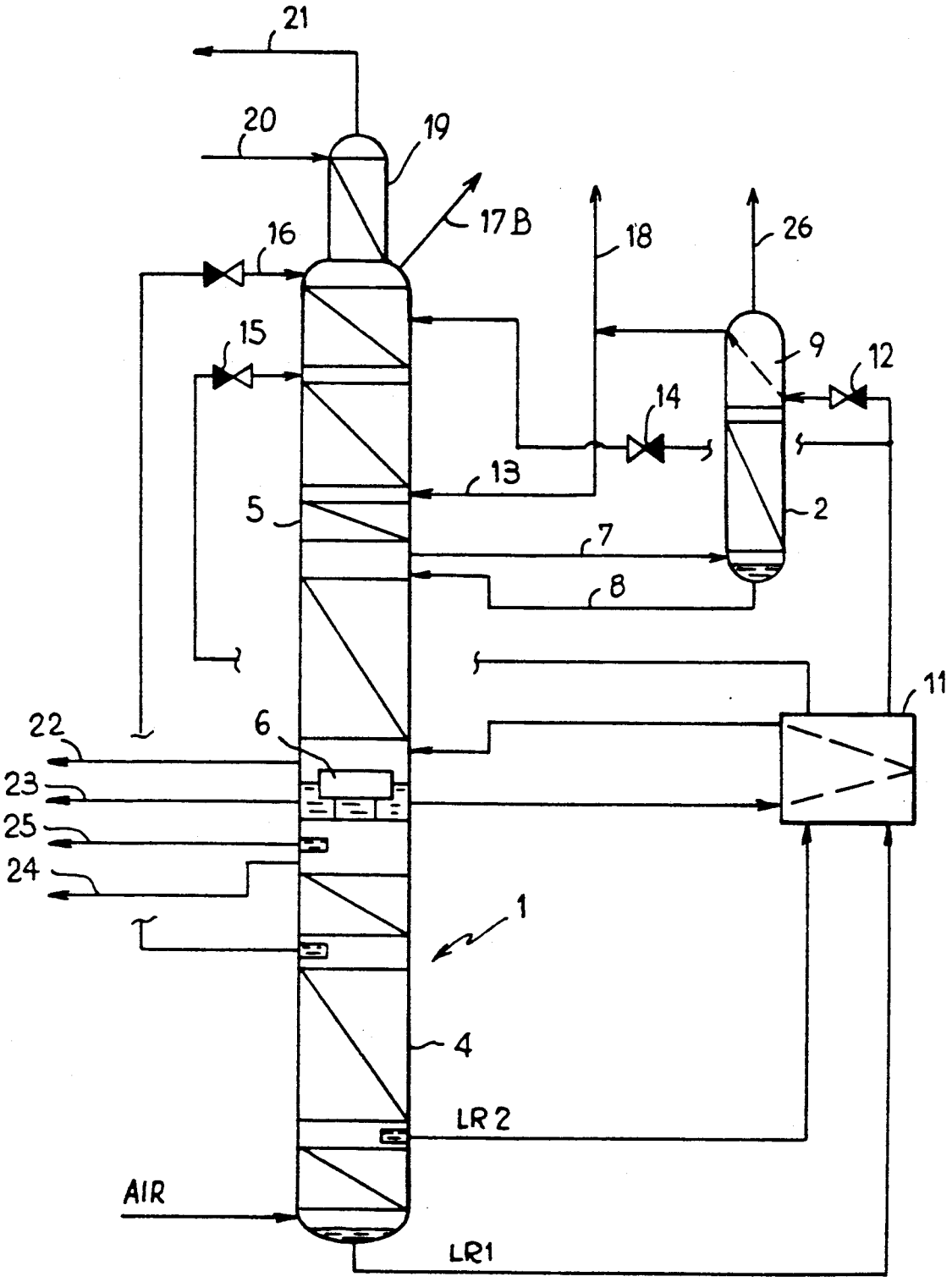

The apparatus illustrated in FIG. 3 differs from that of FIG. 1 only by the absence of mixing section 3: the fraction of rich liquid LR1 which is not sent to condenser 9 is directly sent, after expansion in expansion valve 14, into column 5, and the residual gas withdrawn by means of duct 18, consists of at least a portion of the gas resulting from the total vaporization of rich liquid LR1 carried out in the condenser 9, the remaining portion of this gas being, as previously, sent into column 5 via duct 13. A duct 17B enables to withdraw a second residual gas consisting of impure nitrogen from the apparatus, at the top of column 5.

It should be noted that, although it contains more oxygen than liquid LR2, the liquid expanded at 14 is injected into column 5 above the point where liquid LR2 is introduced, because it contains less argon than the latter. This increases the yield of argon of the apparatus.

Figure 4:
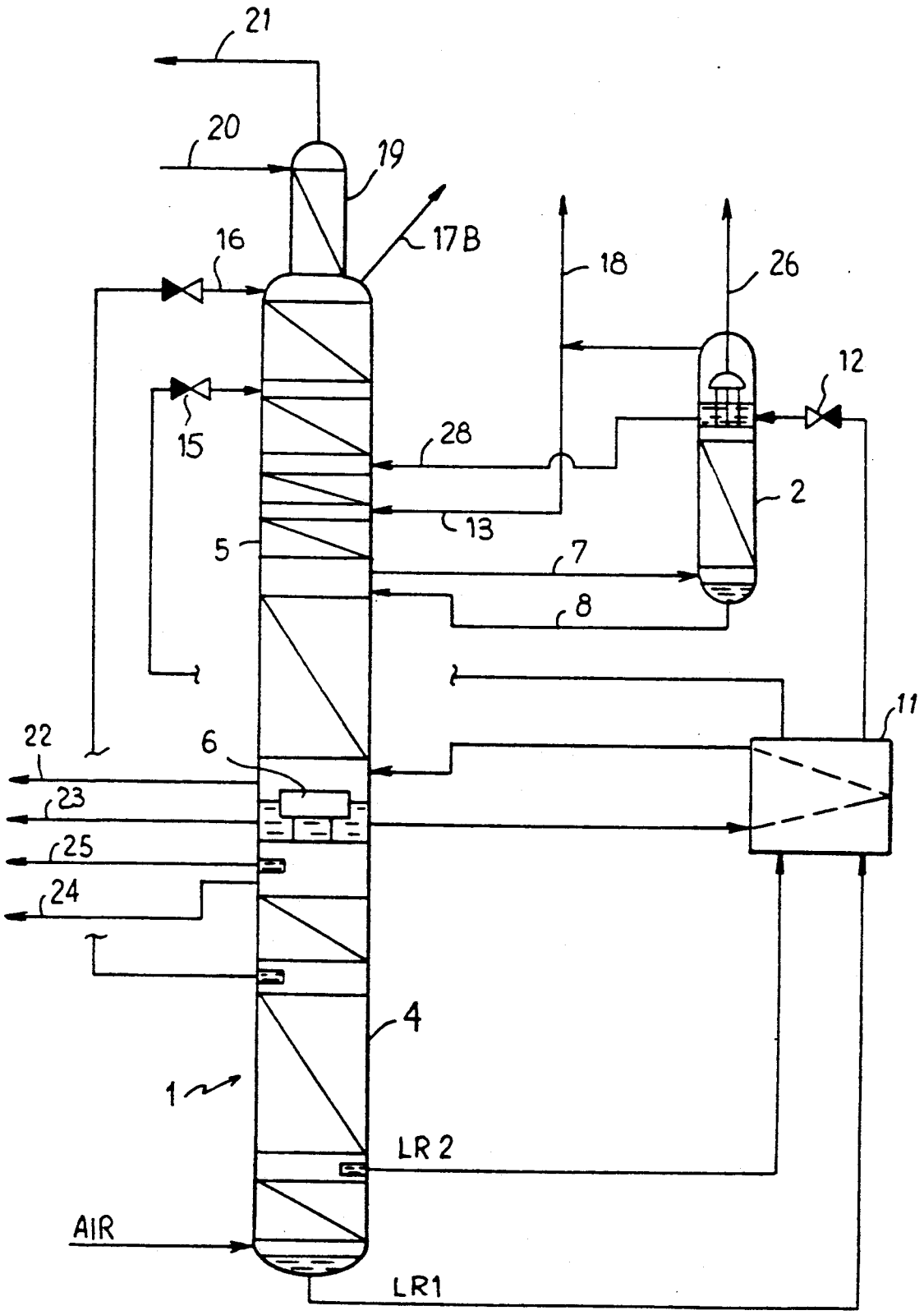

The apparatus illustrated in FIG. 4 differs from the previous one only by the fact that the entire liquid LR1, after expansion in valve 12, is sent into condenser 9, where it is only partially vaporized. The non-vaporized liquid which is enriched in oxygen, is sent as reflux into column 5 via duct 28, and the gas resulting from vaporization, as shown in FIG. 3, is partially withdrawn from the apparatus as residual gas via duct 18. For the same reason as in FIG. 3, it is the argon content of the liquid that circulates in duct 28 which determines the level where this liquid is injected into column 5.

In the example illustrated, this liquid contains more argon than Liquid LR2, and duct 28 consequently opens below liquid LR2.

We claim:

1. A process for the separation of air to produce argon in an apparatus including a higher pressure distillation column having a top and a bottom, a lower pressure distillation column having a top and a bottom, an argon column having a bottom portion operatively coupled to the LP column, and a condenser for producing reflux for the argon column, which comprises the steps of:

injecting cooled air at the bottom of the HP column;

withdrawing and expanding a first rich liquid from the bottom of the HP column;

passing at least a fraction of the withdrawn and expanding first rich liquid through the condenser and then into the LP column;

generating and withdrawing a residual gas from at least a fraction of the withdrawn first rich liquid;

withdrawing a second rich liquid from an intermediate point of the HP column, expanding the withdrawn second rich liquid and introducing the expanded withdrawn second rich liquid as reflux into the LP column; and withdrawing gaseous argon from the top of the argon column.

2. The process of claim 1, wherein the intermediate point is in a zone of the HP column where the argon content is maximum.

3. The process of claim 2, wherein the apparatus is further provided with a mixing column section having a top and a bottom in fluid exchange relationship with the LP column, and comprising the steps of sending at least a part of the withdrawn first rich liquid to the top of the mixing column section, and withdrawing said residual gas from the top of the mixing column section.

4. The process of claim 3, wherein the first rich liquid part sent to the top of the mixing column is a nonvaporized part of the first fraction passed through said condenser.

5. The process of claim 2, wherein a part of the vaporized first rich liquid vaporized in said condenser comprises said residual gas.

6. The process of claim 5, wherein all the first rich liquid is passed through said condenser.

7. The process of claim 5, further comprising the step of withdrawing an additional residual gas from the top of the LP column.

8. The process of claim 2, further comprising the step of withdrawing a poor liquid from the HP column and expanding it and injecting it as reflux into the LP column.

9. The process of claim 1, further comprising the step of sub-cooling the withdrawn rich liquid by heat exchange with liquid oxygen withdrawn from the bottom of the LP column.

10. The process of claim 1, further comprising the step of providing at the top of the LP column an end column section having a top, injecting liquid nitrogen from the HP column into the top of the end column section, and of collecting pure gaseous nitrogen from the top of the end column section.

11. An apparatus for the separation of air and production of argon comprising:

a higher pressure column having a top, a bottom, an air inlet at the bottom, a first rich liquid outlet at the bottom and a second rich liquid outlet at an intermediate point;

a lower pressure column having a top, a bottom and a rich liquid inlet connected to the second rich liquid outlet of the HP column;

an argon column comprising a bottom in fluid exchange relationship with the LP column;

condenser for supplying reflux to the argon column and having an outlet connected to the LP column;

a rich liquid line extending from the first rich liquid outlet of the HP column and connected to an inlet of the condenser;

and auxiliary means operatively coupled to the rich liquid line for producing an auxiliary residual gas that is withdrawn through an auxiliary residual gas duct.

12. The apparatus of claim 11, wherein the intermediate point is located in a zone of the HP column wherein the argon content is maximum.

13. The apparatus of claim 12, wherein the auxiliary residual gas duct is connected to the outlet of the condenser.

14. The apparatus of claim 12, wherein the LP column further has a second rich liquid inlet in fluid communication with the rich liquid line.

15. The apparatus of claim 14, wherein the LP column further has, at the top, an outlet for an additional auxiliary residual gas.

16. The apparatus of claim 14, wherein the top of the LP column comprises an end column section having a liquid nitrogen inlet in fluid communication with the HP column, and a gaseous nitrogen outlet connected to a nitrogen production line.

17. The apparatus of claim 11, further comprising a mixing column section having a bottom in fluid exchange relationship with the LP column and a top having a liquid inlet in fluid communication with the rich liquid line, and an auxiliary residual gas outlet connected to the auxiliary residual gas duct.

18. The apparatus of claim 17, wherein the mixing column section is disposed at the top of the LP column.

* * * * *